US009991013B2

(12) United States Patent
Parnaste et al.

(10) Patent No.: US 9,991,013 B2
(45) Date of Patent: Jun. 5, 2018

(54) PRODUCTION ASSEMBLIES AND REMOVABLE TARGET ASSEMBLIES FOR ISOTOPE PRODUCTION

(71) Applicant: General Electric Company, Schenectady, NY (US)

(72) Inventors: Martin Parnaste, Uppsala (SE); Tomas Eriksson, Uppsala (SE); Johan Larsson, Uppsala (SE); Magnus Bondeson, Uppsala (SE)

(73) Assignee: General Electric Company, Schenectady, NY (US)

( * ) Notice: Subject to any disclaimer, the term of this patent is extended or adjusted under 35 U.S.C. 154(b) by 370 days.

(21) Appl. No.: 14/754,878

(22) Filed: Jun. 30, 2015

(65) Prior Publication Data

US 2017/0004898 A1 Jan. 5, 2017

(51) Int. Cl.

| | |
|---|---|
| ***G21K 5/08*** | (2006.01) |
| ***G21G 1/10*** | (2006.01) |
| ***H05H 6/00*** | (2006.01) |

(52) U.S. Cl.

CPC ..... *G21G 1/10* (2013.01); *H05H 6/00* (2013.01); *G21K 5/08* (2013.01); *H05H 2277/116* (2013.01)

(58) Field of Classification Search

CPC .. G21G 1/10; G21K 5/08; H05H 6/00; H05H 2277/116

USPC ..... 376/202

See application file for complete search history.

(56) References Cited

U.S. PATENT DOCUMENTS

| | | | | |
|---|---|---|---|---|
| 4,752,432 | A | 6/1988 | Bida et al. | |
| 5,917,874 | A | 6/1999 | Schlyer et al. | |
| 6,011,825 | A * | 1/2000 | Welch | G21G 1/10 376/195 |
| 6,160,862 | A | 12/2000 | Wiencek et al. | |

(Continued)

FOREIGN PATENT DOCUMENTS

WO 2009105546 A2 9/2009

OTHER PUBLICATIONS

International Search Report and Written Opinion for corresponding PCT Application No. PCT/US2016/031799 dated Sep. 15, 2016; 11 pages.

*Primary Examiner* — Jack W Keith
*Assistant Examiner* — Daniel Wasil
(74) *Attorney, Agent, or Firm* — Dean D. Small; The Small Patent Law Group, LLC

(57) ABSTRACT

Production assembly for an isotope production system. The production assembly includes a mounting platform including a receiving stage that faces an exterior of the mounting platform. The mounting platform includes a beam passage that opens to the receiving stage and a stage port that is positioned along the receiving stage. A particle beam is configured to project through the beam passage and through the receiving stage during operation of the isotope production system. The stage port is configured to provide or receive a fluid through the receiving stage during operation of the isotope production system. The production assembly also includes a target assembly having a production chamber configured to hold a target material for isotope production. The target assembly includes a mating side that is configured to removably engage the receiving stage during a mounting operation.

9 Claims, 12 Drawing Sheets

(56) References Cited

U.S. PATENT DOCUMENTS

| | | | |
|---|---|---|---|
| 6,586,747 | B1 | 7/2003 | Erdman |
| 7,512,206 | B2 | 3/2009 | Wieland |
| 7,940,881 | B2 | 5/2011 | Jongen et al. |
| 7,978,805 | B1 | 7/2011 | Blackburn |
| 8,288,736 | B2 | 10/2012 | Amelia et al. |
| 8,670,513 | B2 | 3/2014 | Stokely |
| 2004/0100214 | A1 | 5/2004 | Erdman |
| 2009/0296872 | A1 | 12/2009 | Bedeschi |
| 2010/0025251 | A1 | 2/2010 | Bedeschi |
| 2011/0255646 | A1 | 10/2011 | Eriksson et al. |

* cited by examiner

PRODUCTION ASSEMBLIES AND REMOVABLE TARGET ASSEMBLIES FOR ISOTOPE PRODUCTION

BACKGROUND

The subject matter herein relates generally to isotope production systems and, more specifically, to systems and assemblies that are configured to directly or indirectly hold target material during isotope production.

Radioisotopes (also called radionuclides) have several applications in medical therapy, imaging, and research, as well as other applications that are not medically related. Systems that produce radioisotopes typically include a particle accelerator, such as a cyclotron, that accelerates a beam of charged particles (e.g., H− ions) and directs the beam into a target material to generate the isotopes. The cyclotron includes a particle source that provides the particles to a central region of an acceleration chamber. The cyclotron uses electrical and magnetic fields to accelerate and guide the particles along a predetermined orbit within the acceleration chamber. The magnetic fields are provided by electromagnets and a magnet yoke that surrounds the acceleration chamber. The electrical fields are generated by a pair of radio frequency (RF) electrodes (or dees) that are located within the acceleration chamber. The RF electrodes are electrically coupled to an RF power generator that energizes the RF electrodes to provide the electrical field. The electrical and magnetic fields cause the particles to take a spiral-like orbit that has an increasing radius. When the particles reach an outer portion of the orbit, the particles may form a particle beam that is directed toward the target material for isotope production.

Target material (also referred to as starting material) is typically housed within a target assembly that is positioned within the path of the particle beam. The target assembly may be attached to the cyclotron, positioned proximate to the cyclotron, or positioned away from the cyclotron. In some cases, a beam pipe may extend between the cyclotron and the target assembly. The particle beam is directed through the beam pipe and toward the target assembly. The target assembly includes a target body having a production chamber that holds the target material. The target material may be delivered and withdrawn from the production chamber by a fluidic circuit of tubes.

During the lifetime operation of an isotope production system, it is necessary to remove a target assembly for maintenance. For example, one or more parts of the target assembly may be replaced or cleaned to remove unwanted material that reduces production efficiency. The parts may be radioactive and, as such, it is desirable to limit the amount of time that a technician is exposed to the radioactive material. In order to secure the target assembly in the operative position, however, a number of steps must be performed to mechanically, fluidically, and electrically connect the target assembly to the isotope production system. For example, it may be necessary to secure the target body to another component, such as the cyclotron or the beam pipe, so that the path taken by the particle beam is vacuum sealed. In addition, the target assembly is often fluidically coupled to a number of tubes that deliver the target material and a cooling liquid. Each of these tubes may be separately coupled to a port of the system. The target assembly may also be electrically coupled to a control system so that the control system may, for example, monitor conditions of the target assembly. Each of these connections requires one or more steps to be performed, which increases the amount of time that a technician might be exposed to radioactive material. Moreover, if one or more of the above steps is performed incorrectly, the efficiency in producing isotopes may be reduced and/or the risk of damage to the isotope production system may be increased.

BRIEF DESCRIPTION

In an embodiment, a production assembly for a radioisotope production system is provided. The production assembly includes a mounting platform including a receiving stage that faces an exterior of the mounting platform. The mounting platform includes a beam passage that opens to the receiving stage and a stage port that is positioned along the receiving stage. A particle beam is configured to project through the beam passage and through the receiving stage during operation of the radioisotope production system. The stage port is configured to provide or receive a fluid through the receiving stage during operation of the radioisotope production system. The production assembly also includes a target assembly having a production chamber configured to hold a target material for radioisotope production. The target assembly includes a mating side that is configured to removably engage the receiving stage during a mounting operation. The mating side includes a target port and a beam cavity that is aligned with the production chamber. The target port fluidically couples to the stage port and the beam passage aligns with the beam cavity as the target assembly is mounted to the receiving stage.

In an embodiment, a removable target assembly for radioisotope production is provided. The removable target assembly includes a target body having a production chamber configured to hold a target material. The target body includes a beam cavity that is configured to receive a particle beam from outside of the target body. The beam cavity is positioned such that the particle beam is incident upon the target material in the production chamber when the particle beam extends along a designated axis. The target body has an exterior mating side that is configured to removably engage a mounting platform. The target body has a channel inlet and a channel outlet that are in flow communication through a body channel and are positioned along the mating side. The beam cavity has a cavity opening positioned along the mating side. The cavity opening, the channel inlet, and the channel outlet are configured to operatively couple to the mounting platform when the mating side is mounted onto the mounting stage in a direction that is parallel to the designated axis.

In an embodiment, a production assembly for a radioisotope production system is provided. The production assembly includes a mounting platform having a set of receiving stages that are each configured to engage a corresponding target assembly. Each of the receiving stages faces an exterior of the mounting platform and has a respective opening to a beam passage. A particle beam is configured to project through the respective opening during operation of the radioisotope production system. Each of the receiving stages includes an outlet stage port and an inlet stage port that are positioned along the respective receiving stage. The outlet stage port is configured to provide a fluid through the receiving stage, and the inlet stage port is configured to receive the fluid through the receiving stage. The inlet stage port of one of the receiving stages of the set is in flow communication with the outlet stage port of another receiving stage of the set.

DETAILED DESCRIPTION

Figure 1:
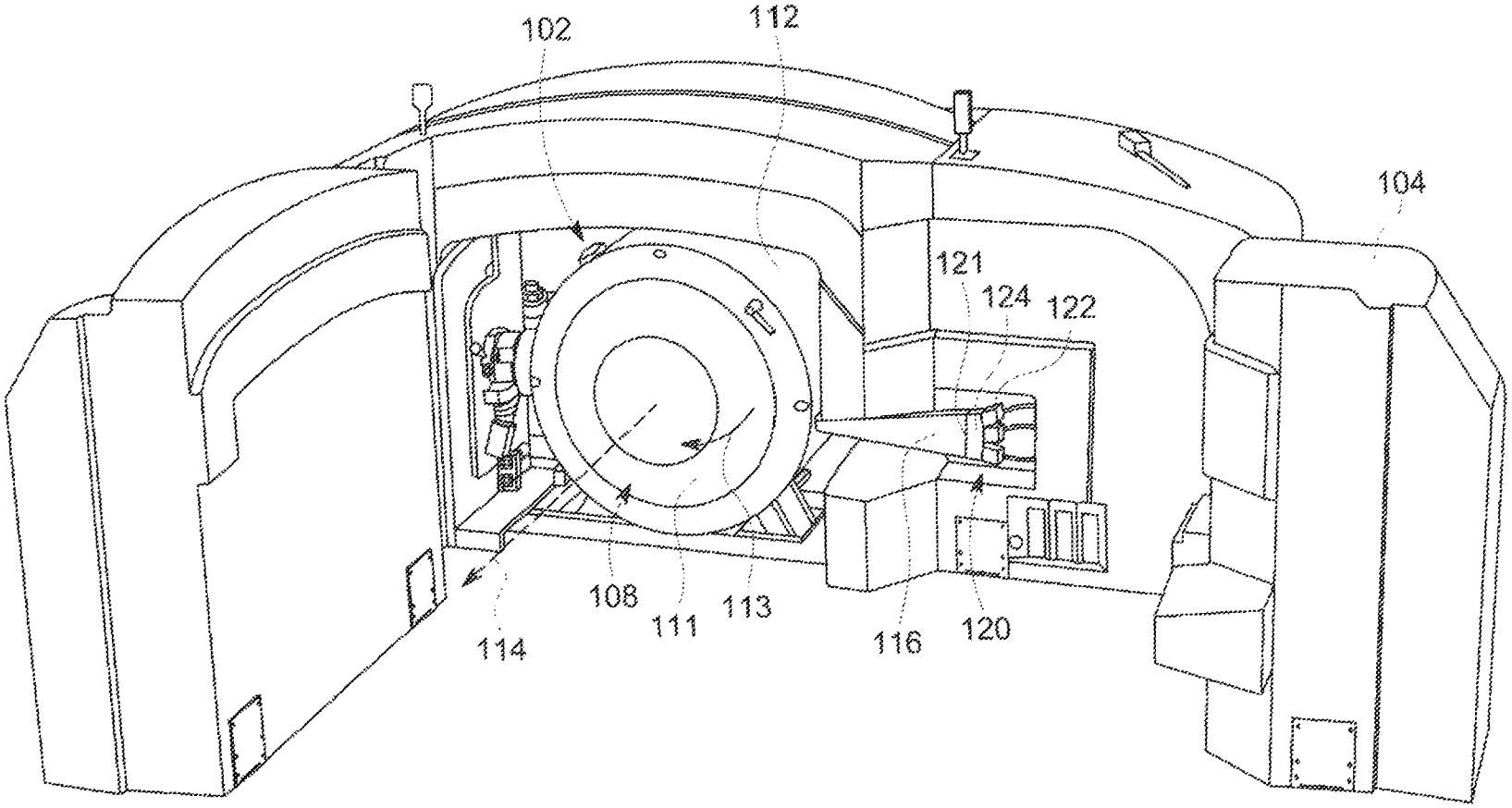
FIG. 1 is a perspective view of an isotope production system in accordance with an embodiment.

Embodiments set forth herein include isotope production systems, production assemblies, target assemblies, mounting platforms, and methods of manufacturing or using the same. Embodiments may also include sub-components of the above, such as a stage adapter. A technical effect provided by one or more embodiments may include a reduction in the total amount of time that an individual is exposed to radioactive material while assembling or performing maintenance on an isotope production system. Another technical effect provided by one or more embodiments may include a reduction in the total amount of time that is used to assemble and/or perform maintenance on an isotope production system or its sub-systems. Another technical effect provided by one or more embodiments may include a more effective means for removing thermal energy from parts that absorb thermal energy from the particle beam.

Yet another technical effect may include the ability to operatively connect a target assembly to an isotope production system in a manner that is easier than known systems. For example, in some embodiments, an individual may operatively mount a target assembly to a mounting platform with a limited number of actions by the individual. In particular embodiments, a single mounting step or stroke may position the target assembly at a designated location relative to the mounting platform and also establish at least one of a fluidic connection, an electrical connection, or a vacuum-sealed connection.

The following detailed description of certain embodiments will be better understood when read in conjunction with the appended drawings. To the extent that the figures illustrate diagrams of the functional blocks of various embodiments, the functional blocks are not necessarily indicative of the division between hardware circuitry. For example, one or more of the functional blocks (e.g., processors or memories) may be implemented in a single piece of hardware (e.g., a general purpose signal processor or a block of random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated, such as by stating "only a single" element or step. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 is a perspective view of an isotope production system 100 in accordance with an embodiment. The isotope production system 100 includes a particle accelerator 102 that is operatively coupled to a control cabinet 104 that includes, among other things, an RF power generator (not shown). In the illustrated embodiment, the particle accelerator 102 is an isochronous cyclotron, but other types of particle accelerators may be used in other embodiments. The particle accelerator 102 includes a magnet assembly 108 that includes yoke sections 111, 112 that define an acceleration chamber (not shown). Although not shown, the yoke sections 111, 112 are each coupled to a corresponding electromagnet of the magnet assembly 108. The electromagnets are magnet coils that are surrounded by the respective yoke sections 111, 112. The magnet assembly 108 may also include a pair of pole tops (not shown) that are disposed within the acceleration chamber and may form parts of the yoke sections 111, 112. During operation, the pair of pole tops oppose each other to define at least a portion of the acceleration chamber therebetween.

The isotope production system may be similar to the isotope production systems that are described in U.S. Patent Application Publication No. 2011/0255646 and in U.S. patent application Ser. Nos. 12/492,200; 12/435,903; 12/435,949; 12/435,931; 14/575,993; 14/575,914; 14/575,958; 14/575,885; and Ser. No. 14/755,007, each of which is incorporated herein by reference in its entirety. Although the following description is with respect to the particle accelerator 102 being a cyclotron, it is understood that embodiments may include other particle accelerators and corresponding sub-systems.

When the particle accelerator 102 is not operating, the yoke section 111 may be opened to allow access to the acceleration chamber. More specifically, the yoke sections 111, 112 may be rotatably coupled to each other. The yoke section 111 is configured to swing open (as indicated by the arrow 113) to provide access to the acceleration chamber and configured to close to seal the acceleration chamber. The acceleration chamber is configured to allow charged particles, such as $^{1}H^{-}$ ions, to be accelerated therein along a predetermined curved path that wraps in a spiral manner about an axis 114 that extends between centers of the opposing pole tops. The charged particles are initially positioned proximate to a central region of the acceleration chamber that is located between the pole tops and proximate to the axis 114.

When the particle accelerator 102 is activated, the path of the charged particles may orbit around the axis 114 that extends between the opposing pole tops. The particle accelerator 102 also includes a pair of RF electrodes (not shown)

that are positioned adjacent to one of the pole tops. The RF electrodes are configured to be energized and controlled by the RF power generator to generate an electrical field. The magnetic field is provided by the yoke sections 111, 112 and the electromagnets. When the electromagnets are activated, a magnetic flux may flow between the pole tops and through the yoke sections 111, 112 around the acceleration chamber. When the electrical field is combined with the magnetic field, the particle accelerator 102 may direct the particles along the predetermined orbit. The RF electrodes cooperate with each other and form a resonant system that includes inductive and capacitive elements tuned to a predetermined frequency (e.g., 100 MHz).

In particular embodiments, the system 100 uses $^{1}H^{-}$ technology and brings the charged particles (negative hydrogen ions) to a designated energy with a designated beam current. In such embodiments, the negative hydrogen ions are accelerated and guided through the particle accelerator 102. The negative hydrogen ions may then hit a stripping foil (not shown) such that a pair of electrons are removed and a positive ion, $^{1}H^{+}$ is formed. The positive ion may be directed into an extraction system (not shown). However, embodiments described herein may be applicable to other types of particle accelerators and cyclotrons. For example, in alternative embodiments, the charged particles may be positive ions, such as $^{1}H^{+}$, $^{2}H^{+}$, and $^{3}He^{+}$. In such alternative embodiments, the extraction system may include an electrostatic deflector that creates an electric field that guides the particle beam toward the target material.

The system 100 may be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. In particular embodiments, the system 100 accelerates the charged particles to an energy of approximately 9.6 MeV or less. In more particular embodiments, the system 100 accelerates the charged particles to an energy of approximately 7.8 MeV or less. However, embodiments describe herein may also have an energy above 18 MeV. For example, embodiments may have an energy above 100 MeV, 500 MeV or more. Likewise, embodiments may utilize various beam current values. By way of example, the beam current may be between about of approximately 10-30 μA. In other embodiments, the beam current may be above 30 μA, above 50 μA, or above 70 μA. Yet in other embodiments, the beam current may be above 100 μA, above 150 μA, or above 200 μA.

The charged particles may exit the acceleration chamber in the form of a particle beam that is incident upon target material. In the illustrated embodiment, the charged particles are directed through a beam pipe 116 toward a production assembly 120 that includes the target material. The production assembly 120 may be attached to an end 121 of the beam pipe 116 and include an outer mounting platform 124 and one or more target assemblies 122 that hold a starting material. The target assemblies 122 are configured to mate with the mounting platform 124 to establish a number of operative connections. The operative connections may include at least one of a mechanical connection, a fluidic connection, and an electrical connection. The production assembly 120 may also include one or more computing devices (not shown) that monitor conditions or production of the production assembly 120 and fluidic sub-system (not shown) that provides fluid to the production assembly 120. As used herein, a fluid may be a liquid (e.g., cooling water or target material in the form of liquid) or gas, such as helium or argon.

The charged particles bombard the target material to produce radioisotopes (also called radionuclides). The radioisotopes may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, the production assembly 120 may generate protons to make $^{18}F^{-}$ isotopes in liquid form, $^{11}C$ isotopes as $CO_2$, and $^{13}N$ isotopes as $NH_3$. The target material used to make these isotopes may be enriched $^{18}O$ water, natural $^{14}N_2$ gas, or $^{16}O$-water. In some embodiments, the system 100 may also generate protons or deuterons in order to produce $^{15}O$ gases (oxygen, carbon dioxide, and carbon monoxide) and $^{15}O$ labeled water.

Figure 2:
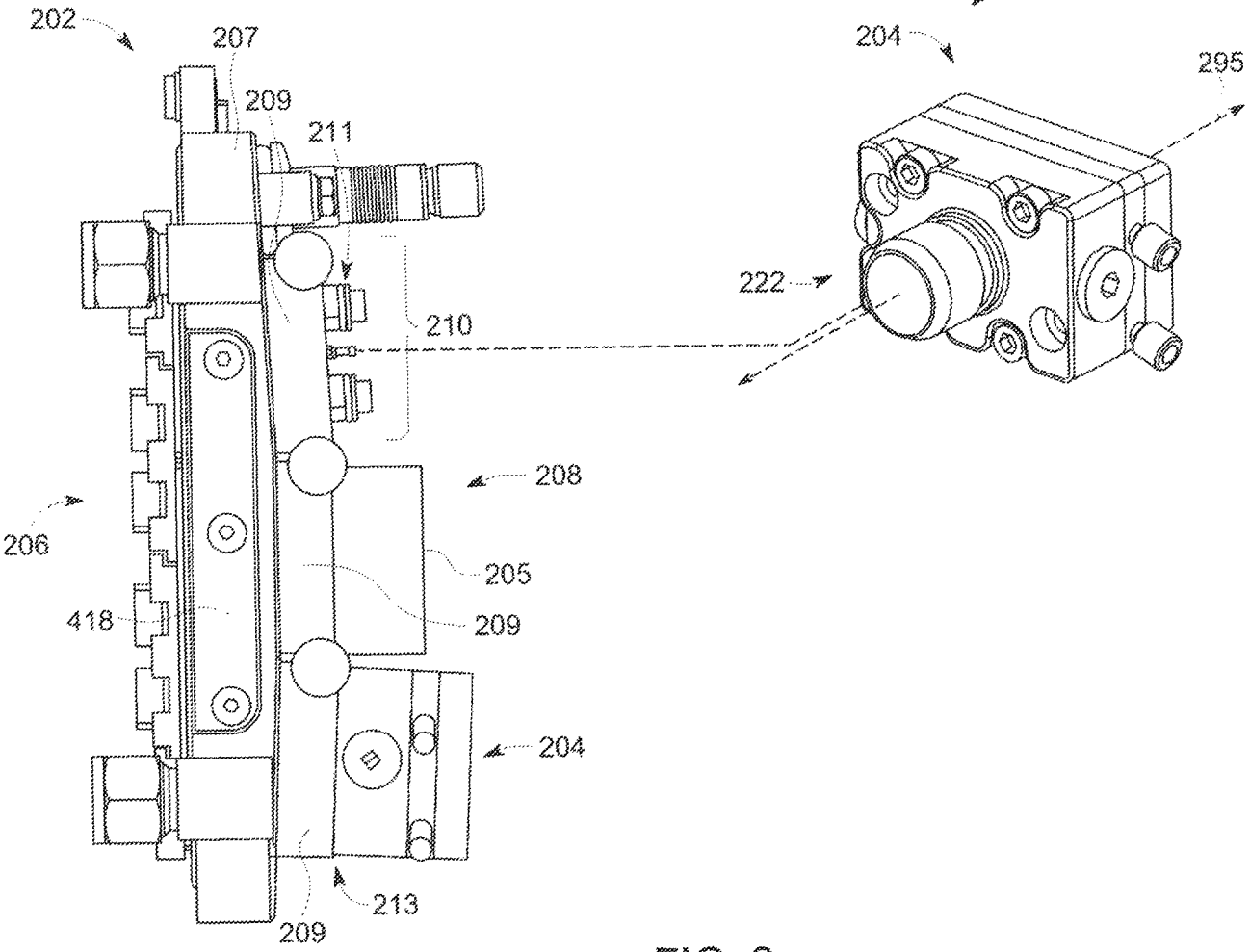
FIG. 2 illustrates a production assembly formed in accordance with an embodiment that may be used by the isotope production system of FIG. 1.

FIG. 2 illustrates a production assembly (or sub-system) 200 formed in accordance with an embodiment. The production assembly 200 may be used with the isotope production system 100 and may be similar or identical to the production assembly 120 (FIG. 1). For example, the production assembly 200 may replace the production assembly 120. As shown, the production assembly 200 includes a mounting platform 202 and one or more target assemblies 204. The target assemblies 204 may form an array of target assemblies 204. In FIG. 2, a side view of the mounting platform 202 is shown and is coupled to one of the target assemblies 204 and a connection block (or dummy target) 205. FIG. 2 also shows a perspective view of the target assembly 204 prior to the target assembly 204 being mated with the mounting platform 202.

The mounting platform 202 includes a platform base 207 and a plurality of stage adapters 209 that are secured to the platform base 207. In the illustrated embodiment, each of the stage adapters 209 is a discrete component that is secured to the platform base 207. Each of the stage adapters 209 includes a receiving stage 210 that faces an exterior of the mounting platform 202 and is configured to mate with a corresponding target assembly 204. In other embodiments, however, the stage adapters 209 are not discrete components of the mounting platform 202. For example, the platform base 207 may include one or more of the features of the stage adapters 209 that are described herein such that the feature(s) of the stage adapters 209 are an integral part of the platform base 207.

The receiving stages 210 form a set 211 of receiving stages 210. As described herein, one or more of the receiving stages 210 in the set 211 may be fluidically coupled to one another in some embodiments. Each of the target assemblies 204 is configured to be removably mounted to the mounting platform 202. As used herein, when two or more elements are "removably mounted" (or "removably coupled" or "removably engaged" or "removably mated" or other like terms) the elements are readily separable without destroying the coupled components. For instance, elements can be "readily separable" when the elements may be separated from each other (a) without undue effort, (b) without the use of a separate tool (e.g., a tool that is not part of one of the elements), and/or (c) without a significant amount of time spent in separating the components. It is understood that these criteria are not necessarily mutually exclusive. For example, if two elements are separated by hand without the use of a separate tool in less than five seconds, the separating process satisfies each of (a), (b), and (c). If two elements are separated in less than fifteen seconds using an electric screwdriver, the separating process may satisfy (a) and (c).

Elements may be readily separable from one another when using a limited amount of hardware, such as fasteners, screws, latches, buckles, nuts, bolts, washers, and the like, such that one or two technicians may couple or uncouple the two elements using only hands of the technician(s) and/or conventional tools (e.g., wrench, screwdriver). In some embodiments, elements that are removably mounted to each other may be coupled without hardware, such as by forming an interference or snap fit with respect to one another.

After the target assembly is fully assembled as shown in FIG. 2 but is not fluidically, mechanically, or electrically connected to the rest of the isotope production system, the target assembly may be operatively mounted to a mounting platform at a designated position within a limited period of time. As used herein, the phrase "operatively mounted [to the mounting platform] at a designated position" includes the position at which the target assembly is operatively coupled to the mounting platform such that the target assembly is in a fixed position and two or more connections that are necessary for operation have been established. A mechanical connection may be the target assembly and the mounting platform being secured to each other. A fluidic connection may include a port of the target assembly being fluidically coupled to a port of the mounting platform so that a fluid may flow therebetween. A fluidic connection may also be the vacuum-sealed path formed by the target assembly and the mounting platform for the particle beam. An electrical connection may include two electrical contacts (or other conductive elements) being connected to each other to establish an electrical pathway. In particular embodiments, the target assembly may be operatively mounted when the target assembly is in a fixed position relative to the mounting platform and each and every connection that is necessary for operation has been established.

By way of example, the target assembly may be operatively mounted to the mounting platform at a designated position in less than ten (10) minutes. In some embodiments, the target assembly may be operatively mounted to the mounting platform at a designated position in less than five (5) minutes. In certain embodiments, the target assembly may be operatively mounted to the mounting platform at a designated position in less than three (3) minutes. In particular embodiments, the target assembly may be operatively mounted to the mounting platform at a designated position in less than one (1) minutes. In more particular embodiments, the target assembly may be operatively mounted to the mounting platform at a designated position in less than thirty (30) seconds.

In some embodiments, the target assembly may be readily demounted from a mounting platform within a limited period of time. For example, when a technician has access to the target assembly (e.g., cabinet is opened), but the target assembly is operatively mounted to the mounting platform, the target assembly may be demounted in less than ten (10) minutes. When the target assembly is demounted, the target assembly does not have any connections to other parts of the isotope production system and may be freely moved away from the mounting platform. In some embodiments, the target assembly may be demounted in less than five (5) minutes. In certain embodiments, the target assembly may be demounted in less than three (3) minutes. In particular embodiments, the target assembly may be demounted in less than one (1) minute. In more particular embodiments, the target assembly the target assembly may be demounted in less than thirty (30) seconds, less than twenty (20) second, less than ten (10) seconds, or less than five (5) seconds.

In some embodiments, a target assembly may be removably mounted to a mounting platform without the use of a separate tool (e.g., a tool that is not part of the target assembly or the mounting platform). In some embodiments, a target assembly may be mounted to a mounting platform with only a single step or a single stroke in which the target assembly is moved toward the mounting platform. In some embodiments, a target assembly may be mounted to a mounting platform with (a) only a single step or a single stroke and (b) a user action to activate a locking device that is coupled to the target assembly or the mounting platform. For example, after the target assembly is mounted to the mounting platform, the technician may move one or more latches or belts that secure the target assembly to the mounting platform.

The term "port" means an opening and one or more surfaces that define the opening. In some cases, a port may also include the objects that have the surfaces that define the opening, such as a conduit or a nozzle. In some cases, a port may also include other objects that interact with the surfaces that define the opening. For example, a port may include a conduit and a spring that biases the conduit at certain positions.

As shown in FIG. 2, the mounting platform 202 includes a first platform side 206 that is configured to be secured to the isotope production system. The platform base 207 may include at least a portion of the first platform side 206. The first platform side 206 may be aligned with and coupled to a beam pipe, such as the beam pipe 116, during operation of the isotope production system. Alternatively, the first platform side 206 may be secured to an intermediate component or directly to the cyclotron. The mounting platform 202 also includes a second platform side 208 that is generally opposite the first platform side 206. The second platform side 208 may be at least partially formed by the stage adapters 209. The second platform side 208 is configured to engage the target assemblies 204.

In the illustrated embodiment, the mounting platform 202 includes the set 211 of receiving stages 210 that form at least a portion of the second platform side 208. The set 211 includes three receiving stages 210 in FIG. 2, but fewer or more receiving stages 210 may be used in other embodiments. Each of the receiving stages 210 is configured to mate with a corresponding target assembly 204 or a connection block 205. In some embodiments, each of the receiving stages 210 may mate with the same type of target assembly 204. For example, the target assembly 204 that is mated to the mounting platform 202 in FIG. 2 may also be demounted and then mated to either of the other two receiving stages 210. In other embodiments, however, the receiving stages 210 may be different such that two or more of the receiving stages 210 may mate with different types of target assemblies 204. In some embodiments, multiple target assemblies 204 may be simultaneously mated with the mounting platform 202. In other embodiments, the mounting platform 202 may simultaneously mate with the connection block 205 and one or more of the target assemblies 204.

In other embodiments, each of the receiving stages 210 may mate with a plurality of types of target assemblies 204. For example, one type of target assembly 204 may be configured to hold a first type of target material and another type of target assembly 204 may be configured to hold a second type of target material. Each of these types of target assemblies 204 may mate with the same receiving stage 210, at separate times.

In some embodiments, the target assembly 204 may be secured in a manner that prevents inadvertent removal of the target assembly 204 from the mounting platform 202. For example, one or more user actions may be required to demount the target assembly.

When a target assembly 204 is mated with the mounting platform 202, a number of operable connections may be established through an interface 213 that is formed between a mating side 222 of the target assembly 204 and the receiving stage 210. The target assembly 204 may be at least one of (a) fluidically connected for receiving cooling media and/or a target material through the interface 213, (b) electrically connected for monitoring the target assembly 204 through the interface 213, (c) or operatively connected for receiving the particle beam through the interface 213. In some embodiments, at least two of the connections (a), (b), or (c) are established through the interface 213. In particular embodiments, the target assembly 204 is fluidically connected, electrically connected, and operatively connected for receiving the particle beam through the interface 213. As used herein, the phrase "operatively connected for receiving a particle beam" includes the target assembly being coupled to the mounting platform such that a vacuum-sealed passage is established that extends through the mounting platform and into the target assembly and is capable of receiving a particle beam.

In some embodiments, when the target assembly 204 is fluidically connected to the mounting platform 202, a fluidic circuit may be formed that extends through the mounting platform 202 and through the target assemblies 204. The mounting platform 202 may be configured to route a cooling fluid (e.g., water or gas, such as helium) through itself and each of the target assemblies 204 and, optionally, the connection block 205. In FIG. 2, the production assembly 200 includes two target assemblies 204 and a single connection block 205. In other embodiments, the production assembly 200 may include three (or more) target assemblies 204 or may only include a single target assembly 204 with multiple connection blocks 205. Due to different possible directions of the particle beam, each of the receiving stages 210 may have a different orientation. As shown in FIG. 2, each of the receiving stages 210 may face in a direction that is non-parallel with respect to the directions of the other receiving stages 210.

Figure 3:
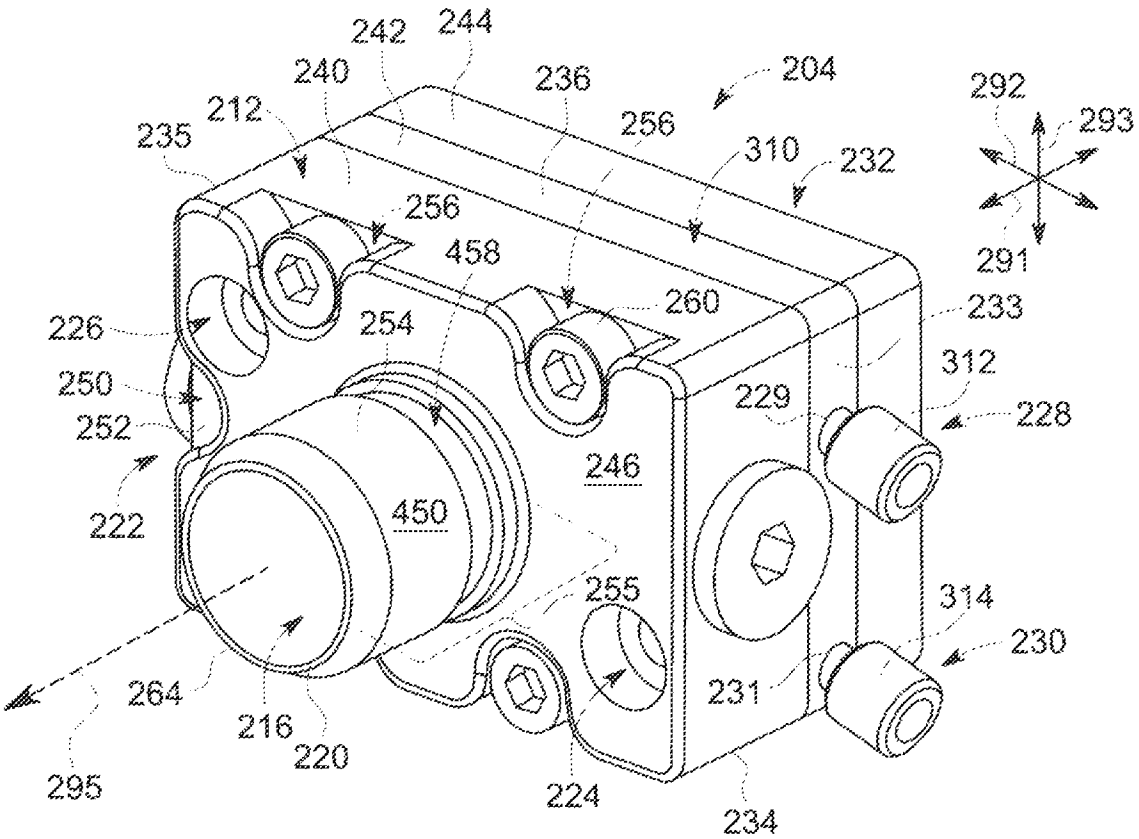
FIG. 3 is an enlarged view of a removable target assembly that may be used by the isotope production system of FIG. 1.

FIG. 3 is an isolated perspective view of an exemplary target assembly 204. The target assembly 204 may include a target body 212 that has a production chamber 214 (shown in FIG. 4) configured to hold the target material for isotope production. The target body 212 includes a plurality of sections that are coupled to one another to form the production chamber 214 and body channels that extend through the target body 212. The target body 212 may surround and house other elements of the target assembly 204, such as one or more foils, sealing members, hardware, etc. The different sections and elements are secured to one another to prevent leakage of fluids (e.g., liquids or gases) and to sustain a vacuum within the production chamber 214. The target body 212 includes a beam cavity 216 that is aligned with the production chamber 214 and is configured to receive a particle beam from outside the target body 212. The target body 212 includes a cavity opening 220 that provides access to the beam cavity 216. When the target assembly 204 is mated to the mounting platform 202, the beam cavity 216 allows the particle beam to be incident on the target material in the production chamber 214.

As described herein, the target body 212 has a mating side 222 that is configured to removably engage the receiving stage 210 of the mounting platform 202 during a mounting (or mating) operation. The target body 212 has a first target port 224 and a second target port 226 that are positioned along the mating side 222. In an exemplary embodiment, the first and second target ports 224, 226 are in flow communication with each other through a body channel of the target body 212. In some embodiments, the body channel functions as a cooling channel that absorbs thermal energy from the target body 212. Alternatively, the body channel may function as a material or target channel that enables delivery and removal of the target material that is irradiated. The first target port 224 may be configured to receive fluid from the mounting platform 202, and the second target port 226 may be configured to provide fluid to the mounting platform 202. As such, the first and second target ports 224, 226 are hereinafter referred to as the inlet target port 224 and the outlet target port 226, respectively. It should be understood, however, that the fluid may flow in the opposite direction. It should also be understood that the first and second target ports 224, 226 may not be in flow communication with each other in other embodiments. In other embodiments, the mating side 222 may include only a single target port. In such embodiments, the body channel may exit through another target port that is not located along the mating side 222.

The cavity opening 220, the inlet target port 224, and the outlet target port 226 are configured to fluidically couple to respective ports of the mounting platform 202 when the target assembly 204 is operatively mounted to the mounting platform 202. In some embodiments, the fluidic connections may be made with a single mounting step or stroke for securing the target assembly 204 to the mounting platform 202. In particular embodiments, the cavity opening 220, the inlet target port 224, and the outlet target port 226 open in a common direction. For example, the beam cavity 216 may be configured to receive the particle beam along a designated axis 295. Each of the cavity opening 220, the inlet target port 224, and the outlet target port 226 may open in a direction along the designated axis 295. In such embodiments, each of the inlet and outlet target ports 224, 226 and the cavity opening 220 may fluidically couple to a respective port when the mating side 222 is moved in the common direction along the designated axis 295.

Figure 4:
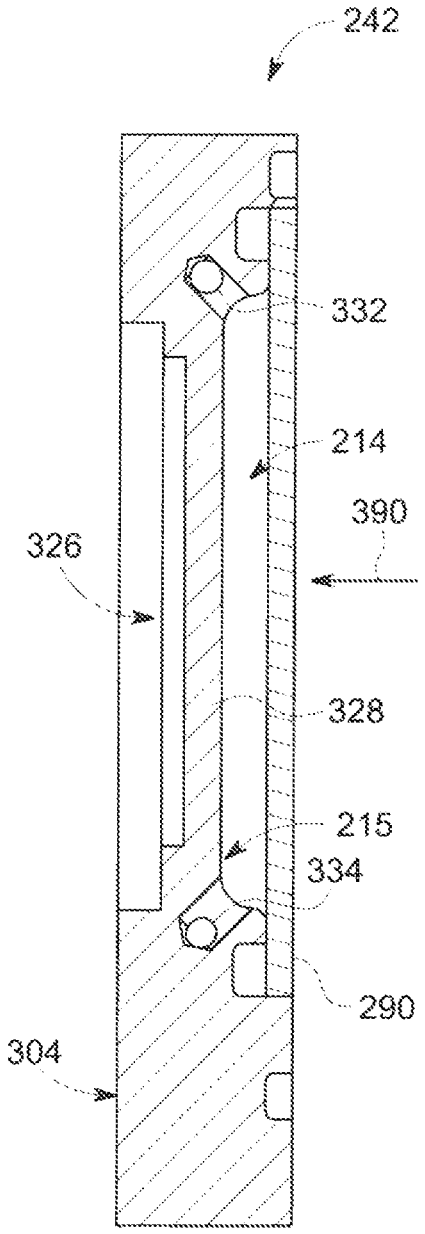
FIG. 4 is a cross-section of a portion of the target assembly of FIG. 1 illustrating a production chamber.

The target body 212 also includes a trailing side 232 and sidewalls 233-236 that extend between the trailing side 232 and the mating side 222. The target assembly 204 may include first and second material ports 228, 230 that are secured to the target body 212. In other embodiments, the first and second material ports 228, 230 may be secured to another side, such as the mating side 222. The first and second material ports 228, 230 are in flow communication with each other through the production chamber 214 (FIG. 4). The target material is configured to be delivered and withdrawn from the production chamber 214 through the first and second material ports 228, 230. In alternative embodiments, the ports 228, 230 may route cooling fluid and the ports 224, 226 may route the target material.

In an exemplary embodiment, the mating side 222 also includes a target neck 254 that has the cavity opening 220 and the beam cavity 216. The target neck 254 is configured to be inserted into a beam passage that is formed by the mounting platform 202. In particular embodiments, the target neck 254 is configured to (a) form a vacuum seal within the beam passage when coupled to the mounting platform 202 and (b) engage the mounting platform 202 such that the target assembly 204 may be held in a locked position during operation of the isotope production system. In the locked position, the target assembly 204 has a fixed position with respect to the mounting platform 202 and may not be inadvertently removed therefrom without a predetermined action or trigger. In alternative embodiments, the mating side 222 does not include a target neck. In such embodiments, the cavity opening 220 may, for example, receive a neck (not shown) of the mounting platform.

In the illustrated embodiment, the target body 212 includes multiple body sections 240, 242, 244. For example, the target body 212 includes a front section or flange 240, an intermediate or insert section 242, and a rear section or flange 244. The body sections 240, 244 may comprise, for example, aluminum, tungsten, or a combination thereof. The body section 242 may comprise, for example, Niobium. The body sections 240, 242, 244 are configured to be stacked side-by-side along a mating axis 291. Optionally, the mating axis 291 may extend parallel to the designated axis 295 (FIG. 2). As shown, each of the body sections 240, 242, 244 is substantially plate-shaped or block-shaped with features formed therein. It should be understood, however, that alternative embodiments may include a different number of body sections and/or the body sections may include different shapes. When the front section 240, the intermediate section 242, and the rear section 244 are stacked together the body sections collectively form the target body 212.

In the illustrated embodiment, the front section 240 includes at least a portion of the mating side 222. The mating side 222 may have a contour or shape that substantially complements the contour or shape of the corresponding receiving stage 210 (FIG. 2). In such embodiments, the mating side 222 may form a snug fit with the receiving stage 210. Optionally, the mating side 222 and/or the receiving stage 210 may be shaped to allow only one orientation of the target assembly 204 with respect to the mounting platform 202 (FIG. 2). For example, the ports 224, 226 of the mating side 202 are positioned such that the target ports 224, 226 will not engage corresponding stage ports of the mounting platform 202 if the target assembly 204 has an improper orientation. Alternatively, the target assembly 204 may have a projection that is configured to be received by a recess of the mounting platform 202 or vice-versa. If the target assembly 204 is not oriented properly, the projection will not allow the target assembly 204 to be mounted to the mounting platform 202.

As shown, the front section 240 includes a front surface 246. The front surface 246 extends parallel to a plane defined by first and second lateral axes 292, 293. The mating axis 291, the first lateral axis 292, and the second lateral axis 293 are mutually perpendicular. The front section 240 may have a number of openings or recesses that open toward or are accessed through the front surface 246. For example, the inlet target port 224 opens towards and is accessed through the front surface 246 and the outlet target port 226 opens toward and is accessed through the front surface 246. The mating side 222 also includes a recess 250 that is partially defined by a contact area 252. The recess 250 opens towards and is accessed through the front surface 246. In an exemplary embodiment, the contact area 252 constitutes an electrical contact that is electrically coupled to an interior of the target assembly 204 such that the target assembly 204 may be electrically monitored through the contact area 252. For example, the contact area 252 may be electrically coupled to a surface 215 that defines the production chamber 214. In alternative embodiments, the contact area 252 may be located along another side of the target body 212. In alternative embodiments, the contact area 252 may be part of a discrete electrical contact, such as a contact finger stamped-and-formed from sheet metal that projects away from the front surface 246. In alternative embodiments, one or more recesses of the front section 240 may be replaced with a protruding portion of the front section 240 that is configured to be inserted into a corresponding recess of the mounting platform 202 (FIG. 2).

The mating side 222 also includes a plurality of hardware recesses 256. In the illustrated embodiment, each of the hardware recesses 256 provides access to a hardware thru-hole that extends entirely through the front section 240 and the intermediate section 242 and at least partially through the rear section 244. The hardware thru-holes are sized and shaped to receive hardware 260. The hardware 260 may include one or more elements used to secure the body sections 240, 242, 244 to each other. In the illustrated embodiment, the hardware 260 includes bolts, but it should be understood that various types of fasteners may be used to secure the body sections 240, 242, 244 to one another, such as screws, latches, buckles, and the like.

The front section 240 also includes the target neck 254. The target neck 254 projects from the front surface 246 in a direction that is parallel to the mating axis 291 and parallel to the designated axis 295 (FIG. 2). The target neck 254 extends a distance 255 to a neck edge 264 that defines the cavity opening 220. The target neck 254 also defines the beam cavity 216, which is aligned with the production chamber 214. The target neck 254 includes a neck surface 450 that defines a neck recess 458. The neck recess 458 opens in a radially outward direction relative to the target neck 254 or the designated axis 295.

The production chamber 214 may be defined between the intermediate section 242 and a foil 290 (shown in FIG. 4) and/or the front section 240. The beam cavity 216 extends from the cavity opening 220 to the foil 290. In other embodiments, the production chamber 214 may be defined between the rear section 244 and the intermediate section 242 and/or the foil 290. Also shown FIG. 3, the intermediate section includes a side edge 310 that extends between the front section 240 and the rear section 244. The side edge 310 includes the first and second material ports 228, 230. In the illustrated embodiment, the first and second material ports 228, 230 include nozzles 312, 314, respectively. The first and second material ports 228, 230 are in flow communication with respective passages that flow into the production chamber 214. The nozzles 312, 314 may be fluidically coupled to tubes (not shown). In some embodiments, the target assembly 204 may include the tubes. In other embodiments, the target assembly 204 does not include the nozzles or the tubes. In such embodiments, the material ports 228, 230 may be defined by openings 229, 231 along the side edge 310.

The intermediate section 242 is configured to be sandwiched between the front section 240 and the rear section 244 in a secured manner to fluidically seal passages or cavities. Although not shown, the target assembly 204 includes a plurality of sealing members (e.g., O-rings or other compressive material that is positioned along seams) that are sandwiched between corresponding components of the target assembly 204 and facilitate sealing fluidic chambers or channels within the target assembly 204.

The target assembly 204 may be essentially independent with respect to other components of the isotope production system such that the target assembly 204 may be demounted and moved away from the mounting platform 202 and the remainder of the isotope production system. In the illustrated embodiment, the non-mating sides (e.g., the trailing side 232 and the sidewalls 233-236) are exterior sides of the target body 212 that do not engage other components of the target assembly 204 or of the isotope production system that restrict movement of the target assembly 204. The non-mating sides may be substantially free from couplings or connections, such as mechanical or fluidic connections, that restrict movement of the target assembly 204. For example, in the illustrated embodiment, the only connections to the non-mating sides are through the first and second material ports 228, 230, which may be connected to flexible tubes (not shown). In such embodiments, the target body 212 may be more quickly removed from the mounting platform 202. For example, the tubes may be connected to the nozzles 312, 314. When the target assembly 204 is demounted, the tubes may be disconnected from the nozzles 312, 314 or disconnected at the opposite ends of the tubes. The target assembly 214 may be demounted with respect to the mounting platform 202, such as described below, and then freely carried away from the mounting platform 202. In other embodiments, the nozzles 312, 314 may be removed from the target body 212.

FIG. 4 is a cross-section of the intermediate section 242 and illustrates the foil 290. As shown, the production chamber 214 is separated from a cooling cavity 326 by a thermal-transfer wall 328. The cooling cavity 326 may be defined between a back surface 304 of the intermediate section 242 and a front surface (not shown) of the rear section 244 (FIG. 3). The intermediate section 242 includes interior ports 332, 334 that are in flow communication with the material ports 228, 230 (FIG. 3), respectively. The channel that extends between the material ports 228, 230 and includes the production chamber 214 may be referred to as a material channel. The channel that extends between the target ports 224, 226 and includes the cooling cavity 326 may be referred to as a cooling channel. The material channel and the cooling channel may also be referred to generally as body channels because the channels extend through the target body 212.

During operation the target material (e.g., starting liquid) is provided to the production chamber 214 with the foil 290 enclosing at least a portion of the production chamber 214. When a particle beam 390 is provided, the particle beam 390 may project parallel to the mating axis 291 (or the designated axis 295) (shown in FIG. 3). A nuclear reaction occurs that is caused by the interaction of the particle beam and the target material, which leads to the production of designated radioisotopes. As the particle beam 390 is applied to the foil 290 and the target material within the production chamber 214, thermal energy within the production chamber 214 is transferred through the thermal-transfer wall 328. The thermal energy may transfer through the thermal-transfer wall 328 and into the cooling cavity 326. The liquid flowing through the cooling cavity 326 may transfer the thermal energy away from the production chamber 214. After the particle beam is applied, the target material may be removed from the production chamber 214 using, for example, an inert gas (e.g., argon).

Figure 5:
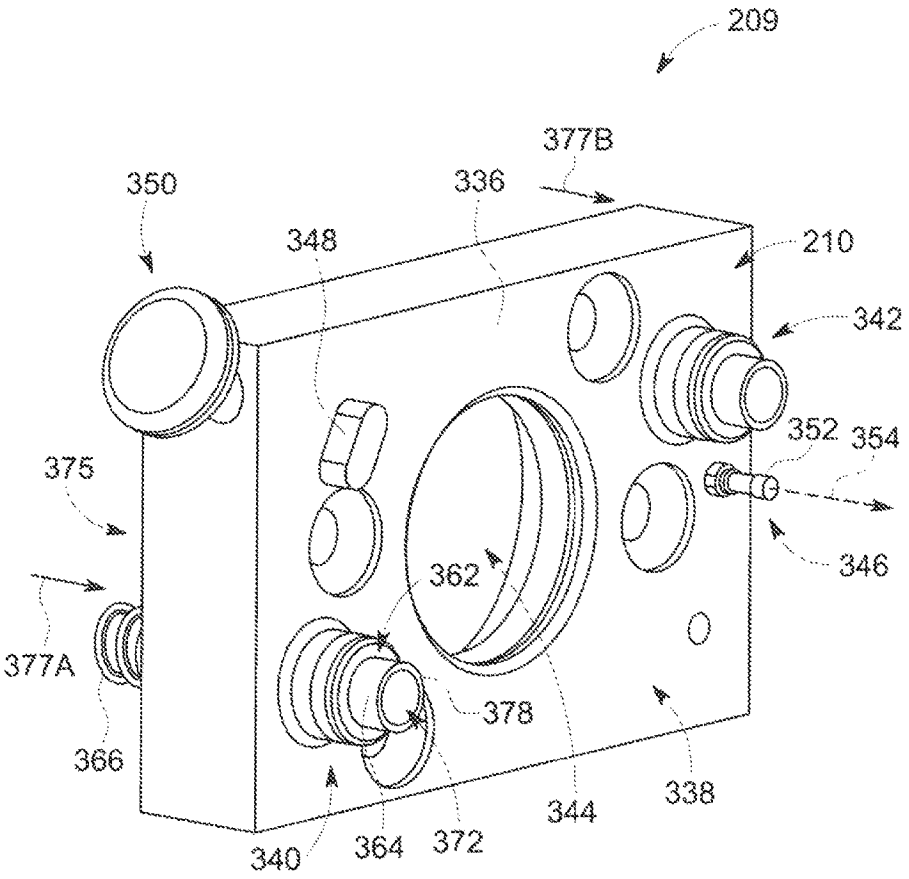
FIG. 5 is an isolated perspective view of a stage adapter that may be used with the isotope production system of FIG. 1.

FIG. 5 is a perspective view of an exemplary stage adapter 209 that may be used with the mounting platform 202 (FIG. 2). As described above, the stage adapter 209 is a discrete component that is configured to be secured to the platform base 207. The stage adapter 209 may be secured to the platform base 207 using hardware, such as bolts (shown in FIG. 10). The stage adapter 209 includes the receiving stage 210. In other embodiments, however, the platform base 207 may be configured to include the features of the receiving stage 210 and/or the stage adapter 209. The receiving stage 210 includes an adapter body 336 having a stage surface 338. In some embodiments, the adapter body 336 includes a dielectric or insulative material for electrically separating or isolating the target assembly 204 (FIG. 2) from the platform base 207. The receiving stage 210 also includes first and second stage ports 340, 342 that are positioned along the receiving stage 210 or, more specifically, the stage surface 338. In an exemplary embodiment, the first stage port 340 is configured to provide a fluid to the target assembly 204 (FIG. 2) during operation of the isotope production system, and the second stage port 342 is configured to receive the fluid from the target assembly 204 during operation of the isotope production system.

The receiving stage 210 also includes a stage thru-hole 344, which is sized and shaped to receive the target neck 254 (FIG. 3). The stage thru-hole 344 may form a portion of a beam passage 460 (shown in FIG. 11). Optionally, the receiving stage 210 may also include an electrical contact 346 and/or a movable actuator 348 of a locking device 350. The electrical contact 346 is positioned along the receiving stage 210 and is configured to engage the contact area 252 (FIG. 3) or other electrical contact during the mounting operation. The electrical contact 346 is configured to be coupled to an electrical conductor (not shown), such as a wire. The electrical contact 346 and/or the electrical conductor may form a conductive path that extends through the adapter body 336. The conductive path may be communicatively coupled to a control system (not shown) for monitoring a current within the target assembly 204. The electrical contact 346 and the movable actuator 348 each project away from the stage surface 338. The movable actuator 348 is configured to engage the target assembly 204 during the mounting operation.

In particular embodiments, each of the outlet stage port 340, the inlet stage port 342, the electrical contact 346, and the movable actuator 348 operatively engage the mating side 222 of the target assembly 204 during the mounting operation. In other embodiments, however, one or more of the outlet stage port 340, the inlet stage port 342, the electrical contact 346, and the movable actuator 348 do not engage the mating side 222 during the mounting operation. In such embodiments, a separate action may be required to couple the corresponding elements. For example, after the target assembly 204 is mated to the stage adapter 209, an electrical wire may be connected to the target assembly 204. The electrical wire may establish an electrical connection for monitoring a current within the production chamber.

Figure 6:
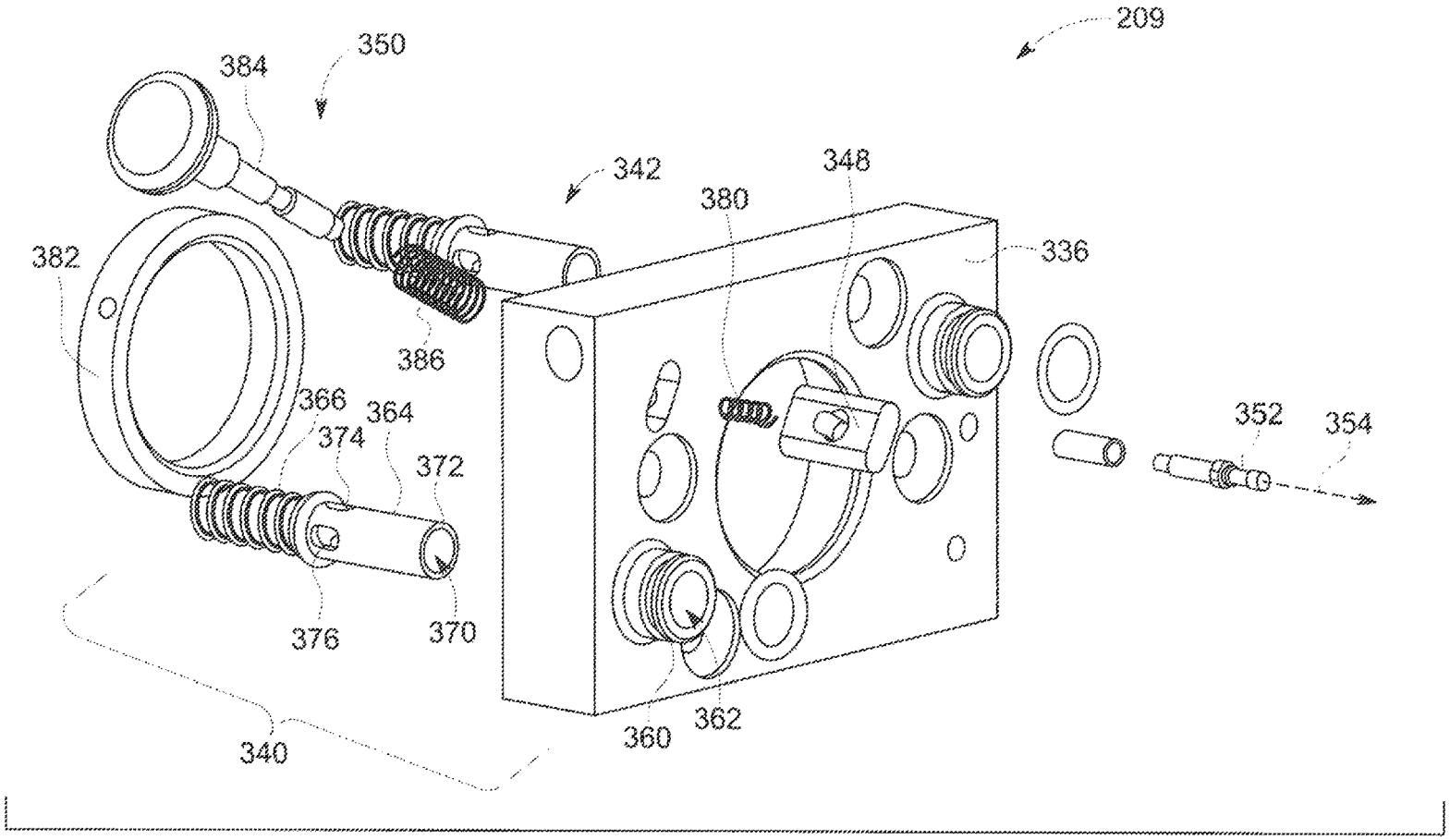
FIG. 6 is an exploded view of the stage adapter of FIG. 5.

FIG. 6 is an exploded view of the stage adapter 209. The movable electrical contact 346 may include a pogo-style pin 352 that is capable of moving back and forth along an axis 354. The pogo-style pin 352 may be pressed into the adapter body 336. However, it should be understood that other types of movable electrical contacts may be used, such as spring fingers. The electrical contact 346 is configured to directly engage the contact area 252 (FIG. 3) and establish an electrical connection therebetween.

Also shown, the outlet stage port 340 includes a port fitting 360 that defines a port passage 362. The port passage 362 extends through the adapter body 336. The outlet stage port 340 also includes a movable conduit 364 and a biasing member 366. As shown, the biasing member 366 is a coil spring, but the biasing member 366 may be other types of biasing members in other embodiments, such as other types of springs, spring fingers that are stamped-and-formed from sheet metal, or spring fingers that are molded from plastic. The biasing member 366 may also be similar to a rubber band that resists movement of the conduit away from the adapter body 336. The movable conduit 364 includes a conduit passage 370 that includes an exterior opening 372 and interior openings 374, 376. The inlet stage port 342 may be similar or identical to the outlet stage port 340 and include a port fitting having a port passage, a movable conduit, and biasing member.

Returning to FIG. 5, the movable conduit 364 is sized and shaped to be disposed within the port passage 362. A leading edge 378 of the movable conduit 364 defines the exterior opening 372. The leading edge 378 is configured to be inserted into the first target port 224 (FIG. 3). More specifically, during the mounting operation, the first target port 224 is aligned with the movable conduit 364. As the target assembly 204 (FIG. 2) is moved toward the receiving stage 210, the leading edge 378 moves into the first target port 224 and engages the target body 212 or sealing member within the first target port 224. The biasing member 366 permits the target assembly 204 to move the movable conduit 364 through the adapter body 336 such that the interior openings 374, 376 clear a back side 375 of the adapter body 336. When in the flexed or compressed position, the biasing member 366 provides a biasing force 377A toward the target assembly 204. The biasing force 377A may remain throughout operation of the isotope production system. Although not described herein, the outlet stage port 342 may operate in a similar manner to provide a biasing force 377B that remains throughout operation of the isotope production system.

Returning to FIG. 6, when the target assembly 204 is operatively mounted to the receiving stage 210, the movable conduit 364 is in a displaced position such that at least one of the interior openings 374, 376 is in flow communication with a base channel of the platform base 207. As such, fluid from the platform base 207 may be directed through the movable conduit 364 and into the target assembly 204. When the target assembly is demounted from the receiving stage 210, however, the biasing member 366 may move the conduit 364 such that the interior openings 374, 376 are not in flow communication with the base channel. For example, the interior openings 374, 376 may be positioned within the adapter body 336. Accordingly, one or more embodiments may include spring-loaded conduits that open a fluid circuit when the target assembly is mounted to the mounting platform and automatically close the fluid circuit when the target assembly is demounted form the mounting platform.

Also shown in FIG. 6, the locking device 350 includes a number of components that interact with each other for engaging and holding the target assembly 204 in a locked position with respect to the mounting platform 202. For example, in the illustrated embodiment, the locking device 350 includes movable actuator 348, an actuator spring 380, a locking ring 382, a locking post 384, and a release spring 386. The locking post 384 and the release spring 386 are inserted through a hole along a side of the adapter body 336. The movable actuator 348 and the actuator spring 380 are inserted into a cavity that opens along the stage surface 338. The hole along the side of the adapter body 336 and the cavity that opens along the stage surface 338 may intersect each other. The locking post 384 may extend through the hole and the cavity. As shown, the movable actuator 348 includes a hole that receives the locking post 384. The locking device 350 is described in greater detail below with reference to FIGS. 5, 6, and 11. In some embodiments, the locking device 350 is activated as the target assembly 204 is mounted to the receiving stage 210. For instance, the action or step that fluidically couples and electrically couples the target assembly 204 to the receiving stage 210 may also trigger the locking device 350.

Figure 7:
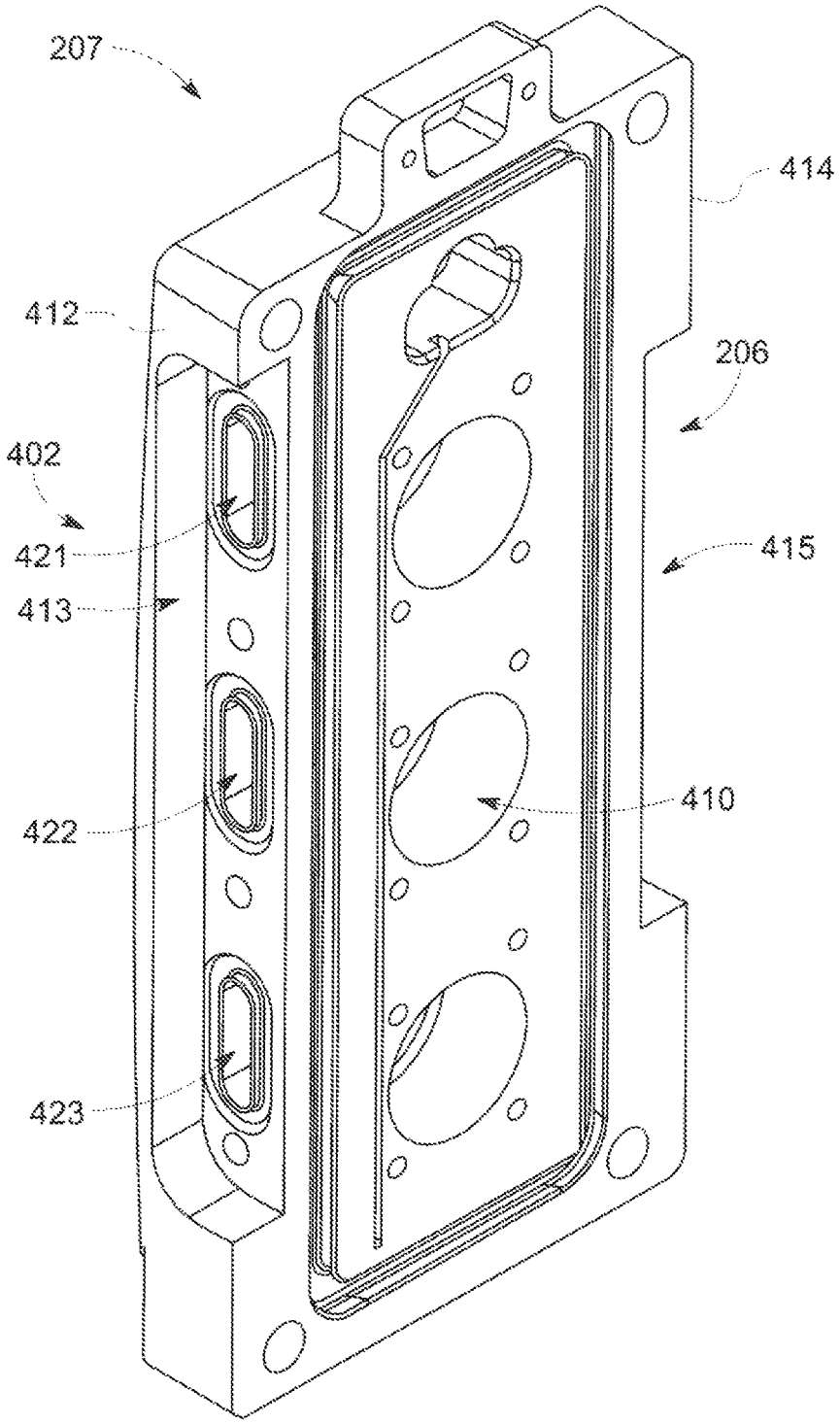
FIG. 7 is a back perspective view of a platform base that may be used with the isotope production system of FIG. 1.
Figure 8:
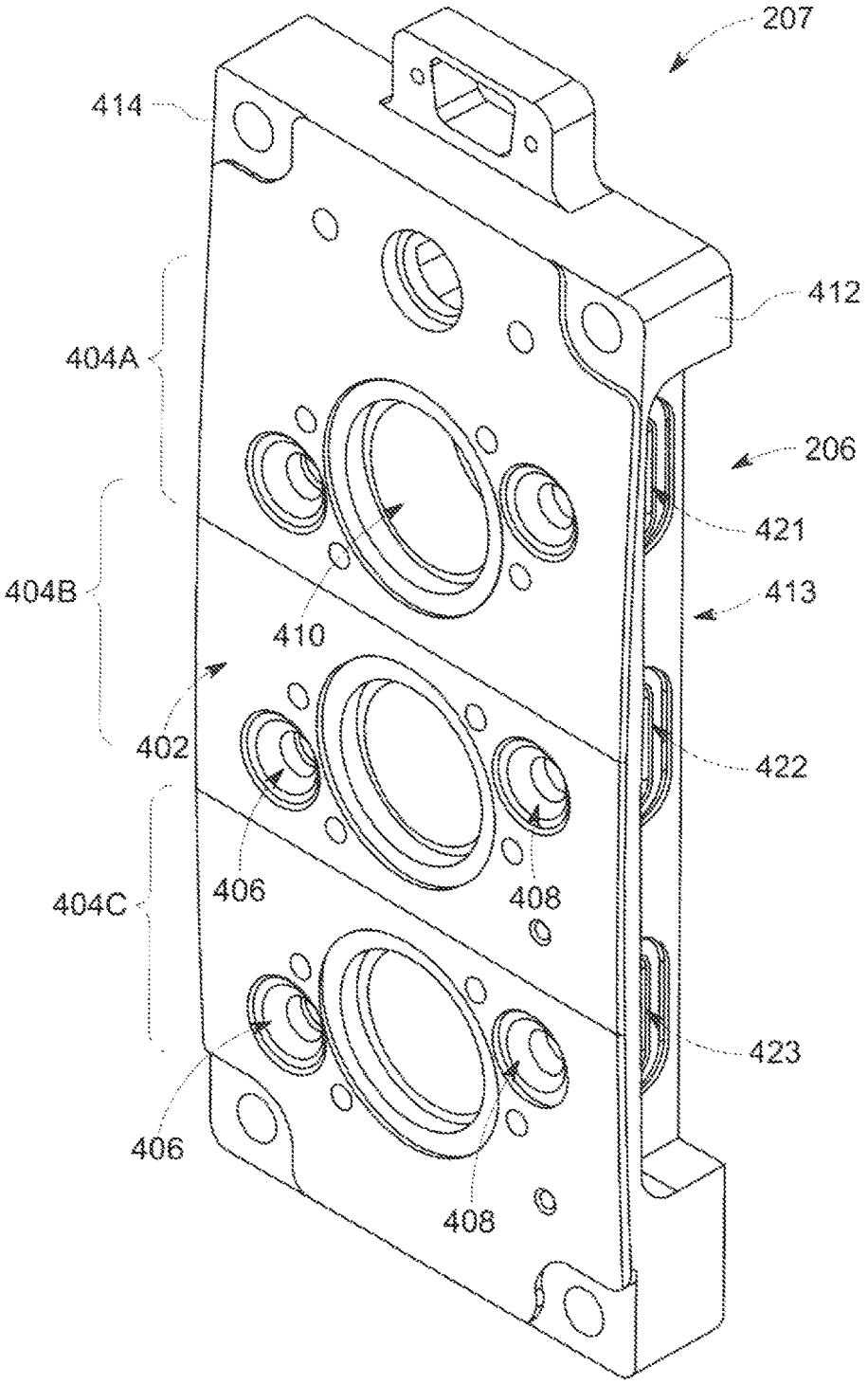
FIG. 8 is a front perspective view of the platform base of FIG. 7.

FIGS. 7 and 8 are a back perspective view and a front perspective view, respectively, of the platform base 207. The platform base 207 includes the first platform side 206 and a base side 402 that is opposite the first platform side 206. In an exemplary embodiment, the base side 402 is configured to have the stage adapters 209 (FIG. 2) mounted thereon. The platform base 207 includes base edges 412, 414 that extend along and between the first platform side 206 and the base side 402. The base edges 412, 414 include cover-reception cavities 413, 415, respectively, that are configured to receive a corresponding cover or lid 418 (shown in FIG. 2).

As shown, the cover-reception cavities 413, 415 include openings to base channels 421, 422, 423. When the corresponding covers 418 are disposed within the cover-reception cavities 413, 415, the base channels 421-423 are sealed. The base channels 421-423 permit a fluid to flow therethrough. In particular embodiments, the platform base 207 may also absorb thermal energy from the particle beam. For example, thermal energy may transfer through surfaces that define base thru-holes 410. The base channels 421-423 are routed through the platform base 207 proximate to the base thru-hole 410 to absorb thermal energy therefrom.

Also shown, the platform base 207 includes a plurality of the base thru-holes 410. As shown in FIG. 8, the platform base 207 includes a plurality of base areas 404A, 404B, 404C that are each configured to have a corresponding stage adapter 209 (FIG. 2) secured thereto. The platform base 207 includes a plurality of circuit ports 406 and a plurality of circuit ports 408 that open to the base side 402. The circuit ports 406 may be referred to as outlet circuit ports 406, and the circuit ports 408 may be referred to as inlet circuit ports 408. Each of the circuit ports 406, 408 provides fluidic access to a corresponding channel within the platform base 207. The outlet and inlet circuit ports 406, 408 are arranged such that each base area 404A-404C includes one outlet circuit port 406 and one inlet circuit port 408.

When a stage adapter 209 (FIG. 2) is operatively secured to the platform base 207, the stage adapter 209 is positioned relative to the corresponding base area 404A, 404B, or 404C such that the stage thru-hole 344 (FIG. 6) is aligned with the corresponding base thru-hole 410 and the outlet and inlet circuit ports 406, 408 receive the outlet and inlet stage ports 340, 342 (FIG. 6), respectively. More specifically, the biasing member 366 (FIG. 6) and the movable conduit 364 (FIG. 6) may be at least partially disposed within the corresponding circuit port. The interior openings 374, 376 (FIG. 6) are configured to move into and out of the corresponding circuit port as described below.

Figure 9:
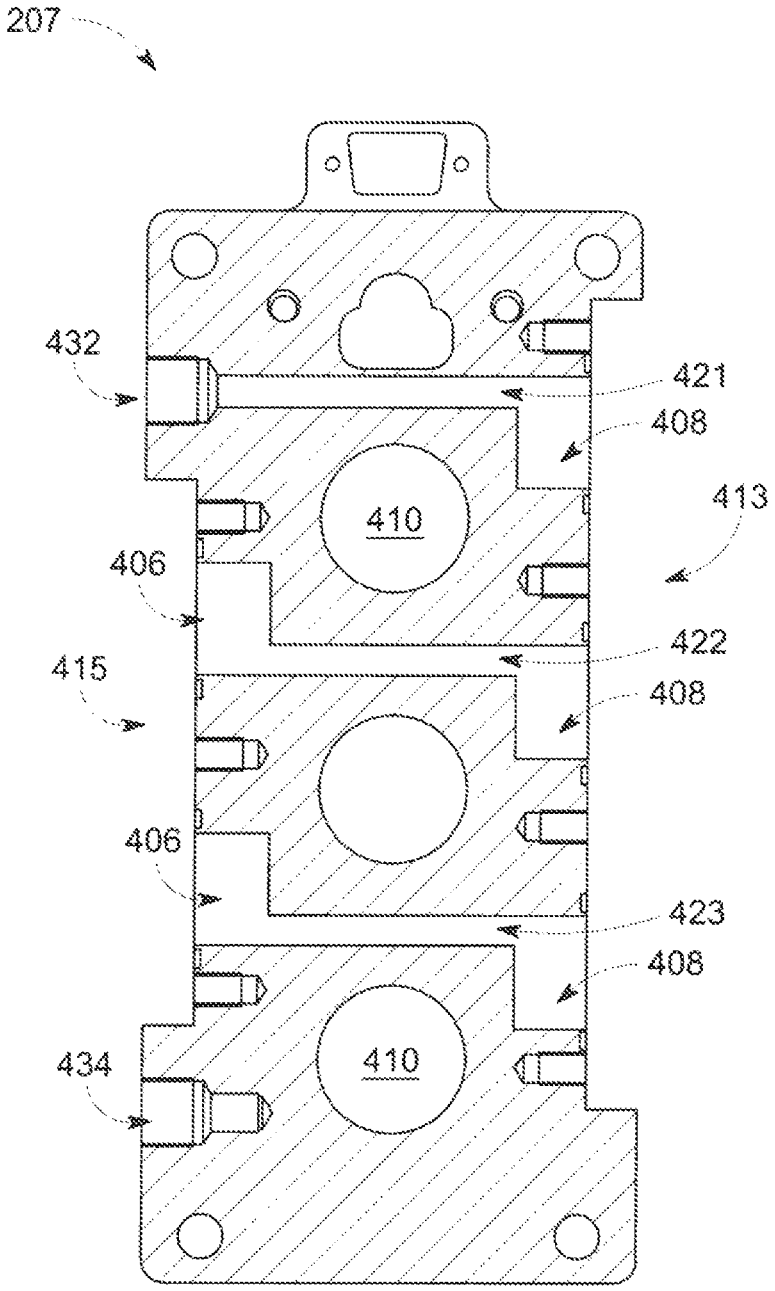
FIG. 9 is a cross-section of the platform base of FIG. 7 illustrating flow channels that extend through the platform base.

FIG. 9 is a cross-section of the platform base 207. Each of the base channels 421-423 extend across a width of the platform base 207 and is in flow communication with two ports. More specifically, the base channel 421 extends between a platform port 432 and the circuit port 408 of the base area 404A (FIG. 8), the base channel 422 extends between the circuit port 406 of the base area 404A and the circuit port 408 of the base area 404B (FIG. 8), and the base channel 423 extends between the circuit port 406 of the base area 404B and the circuit port 408 of the base area 404C (FIG. 8). The base channels 421-423 extend between adjacent base thru-holes 410. As shown, the platform base 207 also includes a platform port 434. The platform port 434 is in flow communication with the circuit port 406 of the base area 404C. When the cover-reception cavities 413, 415, respectively, have the corresponding covers 418 (FIG. 2) disposed therein, fluid is only permitted to flow through the base channels 421-423 by flowing through the corresponding stage adapter 209 (FIG. 2) and target assemblies 204 (FIG. 2).

Figure 10:
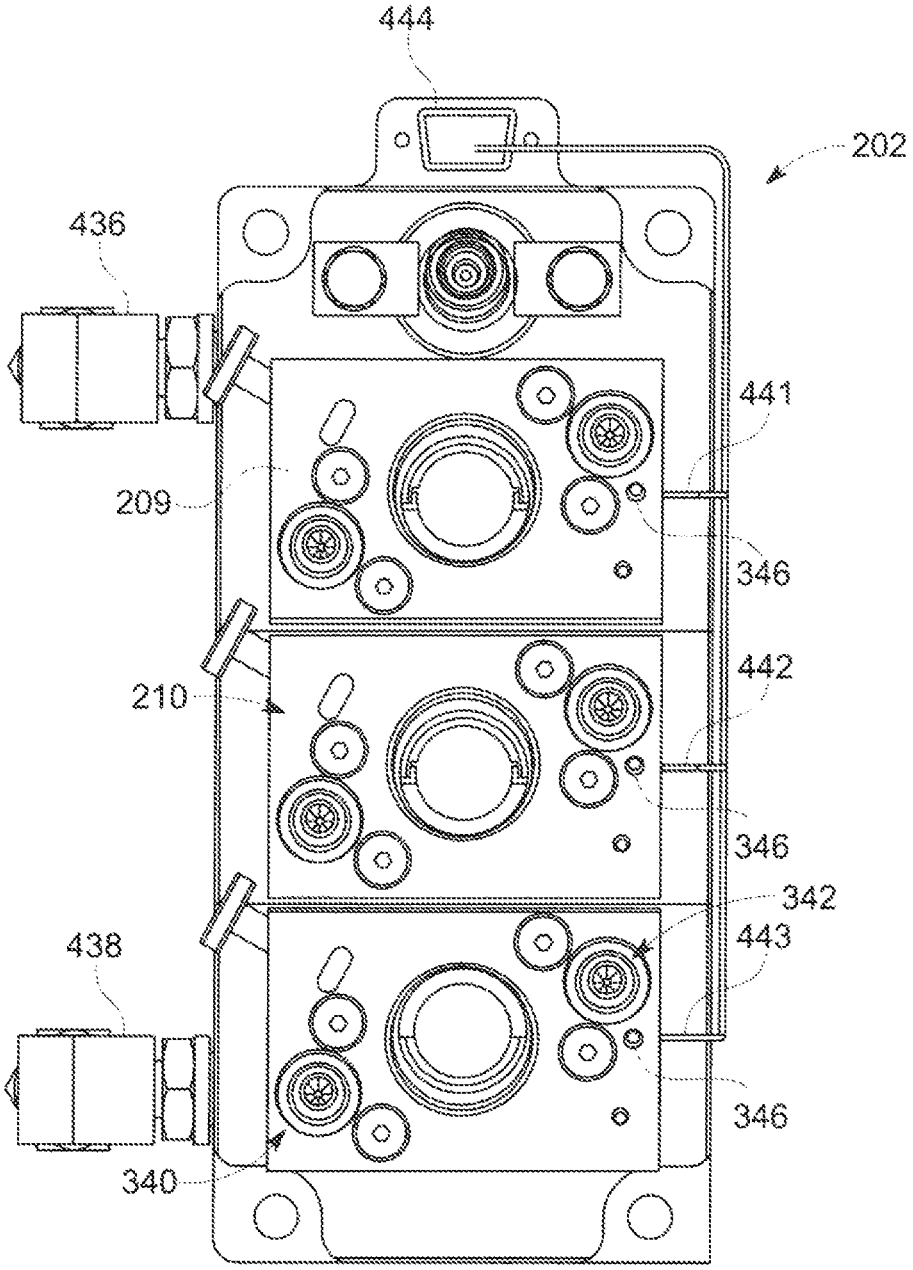
FIG. 10 is a front plan view of the production assembly of FIG. 2.

FIG. 10 is a front plan view of the mounting platform 202. For illustrative purposes, one or more of the target assemblies 204 and/or one or more of the connection blocks 205 (FIG. 2) are not shown. The mounting platform 202 also includes a plurality of electrical wires 441, 442, 443 that electrically couple to corresponding electrical contacts 346 of the stage adapters 209 to an electrical connector 444. The electrical connector 444 is communicatively coupled to a control system (not shown) that may monitor signals (e.g., current) detected by the electrical contacts 346.

The mounting platform 202 includes flow connectors 436, 438 that are coupled to the platform ports 432, 434 (FIG. 9), respectively. With respect to FIGS. 9 and 10, during operation of the isotope production system, a cooling fluid (e.g., water or gas, such as helium) may be pumped through the flow connector 438 and into the platform port 434. The cooling fluid may then flow through the outlet stage port 340 associated with the base area 404C (FIG. 8) and into the inlet target port 224 (FIG. 3) of the corresponding target assembly 204 (or optional connection block 205). If the cooling fluid flows into a target assembly 204, the cooling fluid may flow through one or more channels, such as the cooling cavity 326, to absorb thermal energy from the target assembly 204 and transport the thermal energy therefrom.

The cooling fluid then flows through the outlet target port 226 (FIG. 3) of the target assembly 204 and into the inlet stage port 342 that is associated with the base area 404C. The cooling fluid flows through the inlet circuit port 408 that is associated with the base area 404C and into the base channel 423. The cooling fluid flows through the base channel 423 to the outlet circuit port 406 that is associated with the base area 404B. From the outlet circuit port 406, the cooling fluid flows through the outlet stage port 340 that is associated with the base area 404B and into the inlet target port 224 of the adjacent target assembly 204 (or adjacent connection block 205). If the cooling fluid flows into a target assembly 204, the cooling fluid flows through the target assembly 204 and through the outlet target port 226 into the inlet stage port 342 that is associated with the base area 404B. The cooling fluid flows through the inlet circuit port 408 that is associated with the base area 404B and into the base channel 422. The cooling fluid flows through the base channel 422 to the outlet circuit port 406 that is associated with the base area 404A. From the outlet circuit port 406, the cooling fluid flows through the outlet stage port 340 that is associated with the base area 404A and into the inlet target port 224 of the adjacent target assembly 204 (or adjacent connection block 205). If the cooling fluid flows into a target assembly 204, the cooling fluid flows through the target assembly 204 and through the outlet target port 226 into the inlet stage port 342 that is associated with the base area 404A. The cooling fluid flows through the inlet circuit port 408 that is associated with the base area 404A and into the base channel 421. The cooling fluid then flows through the platform port 432. If a stage adapter 209 associated with any of the base areas 404A-404C is not coupled to a corresponding target assembly 204, a connection block 205 may be coupled thereto instead. The connection block 205 may have a body channel that interconnects the outlet and inlet stage ports 340, 342 of the stage adapter 209.

Accordingly, the mounting platform 202 and the target assemblies 204 (or optional connection blocks 205) may collectively form a fluidic circuit during operation of the isotope production system. More specifically, the mounting platform 202 may include a plurality of the channels that are part of the fluidic circuit and each target assembly 204 may include one or more channels that are part of the fluidic circuit. As such, the same cooling media that cools the target assemblies 204 may also cool the platform base 207. The connection block 205 may include corresponding ports and channels that allow fluid to flow through the connection block 205.

In an exemplary embodiment, a portion of the fluidic circuit is closed or blocked when any one of the receiving stages 210 is not occupied by a target assembly 204 or a connection block 205. For example, if a target assembly 204 (or optional connection block 205) is not operably mounted to one of the receiving stages 210, then the fluidic circuit may be closed such that fluid may not flow through the other target assembly or assemblies. This automatic shut-off feature may be provided by the biasing member 366 and the movable conduit 364 as described herein. In alternative embodiments, however, the automatic shut-off feature may not exist. In such embodiments, the fluidic circuit may be capable of providing fluid through a target assembly even if one or more of the receiving stages are not occupied by a target assembly 204 or connection block 205.

Figure 11:
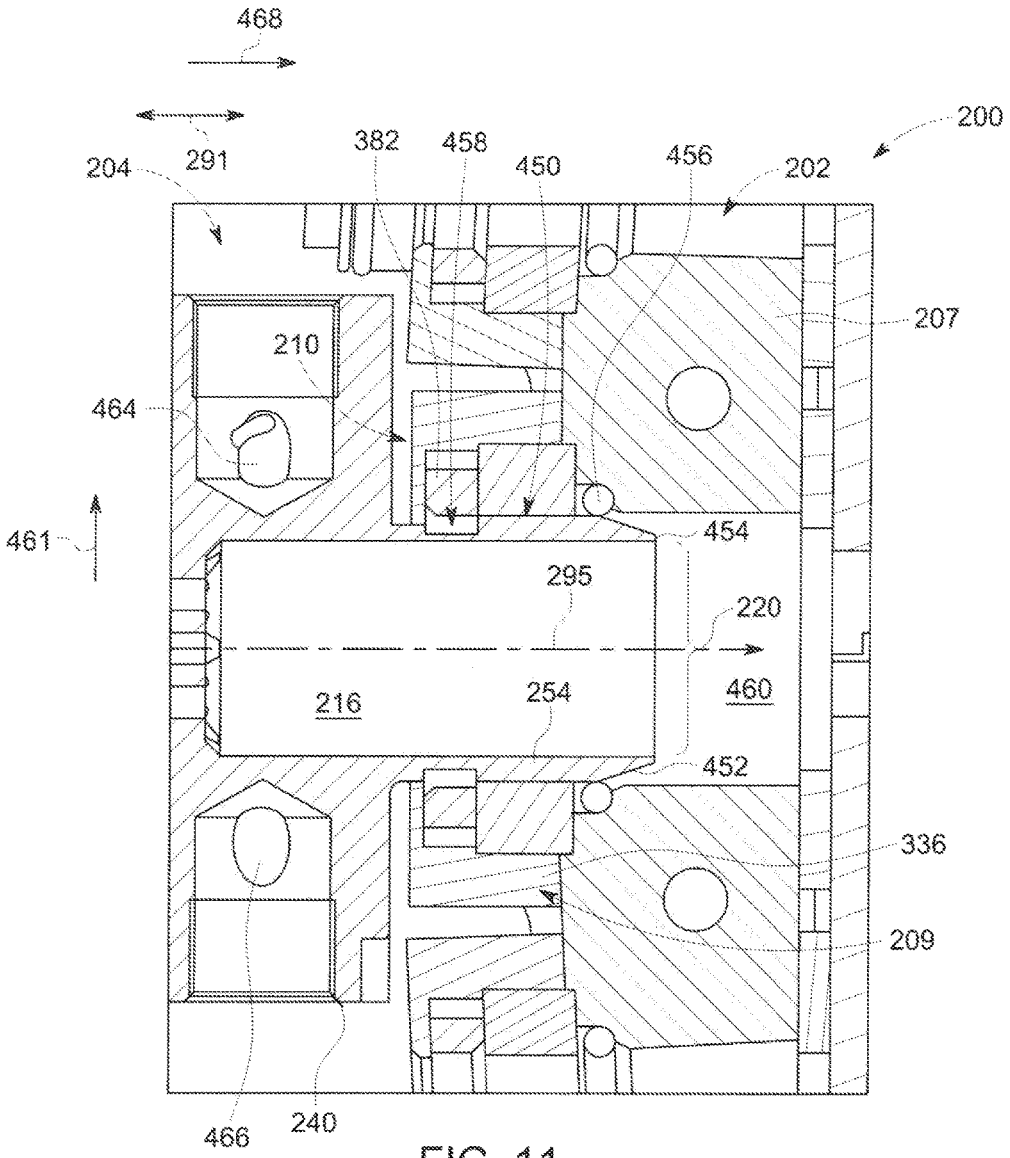
FIG. 11 is a cross-section of the production assembly of FIG. 2 illustrating the target assembly operatively mounted to the mounting platform.

FIG. 11 is an enlarged cross-section of the production assembly 200 illustrating an exemplary target assembly 204 operatively mounted to one of the receiving stages 210 of a corresponding stage adapter 209 of the mounting platform 202. As shown, the adapter body 336 of the stage adapter 209 is disposed between the front section 240 of the target assembly 204 and the platform base 207. The front section 240 and the platform base 207 may comprise metal, such as aluminum. The insulative adapter body 336 is disposed between the target assembly 204 and the platform base 207 and electrically separates the target assembly 204 and the platform base 207.

The front section 240 of the target assembly 204 includes the target neck 254 that defines the beam cavity 216. As shown, the front section 240 also includes interior ports 464, 466 that are in flow communication with each other. The interior parts 464, 466 are interconnected with each other through a cooling channel that surrounds the beam cavity 216 proximate to the production chamber 214. The cooling channel may be a second cooling channel that is configured to absorb thermal energy generated in front of the production chamber 214 (FIG. 4) or the foil 290 (FIG. 4). The designated axis 295 extends through a center of the beam cavity 216 and may correspond to a path taken by the particle beam. The target neck 254 includes the outer conduit surface 450 that faces radially away from the designated axis 295. The conduit surface 450 includes a distal end portion 452 that extends to a conduit edge 454. The conduit edge 454 defines the cavity opening 220.

As shown, the distal end portion 452 is angled or chamfered relative to the designated axis 295. The distal end portion 452 is configured to engage a sealing member 456 (e.g., O-ring) of the mounting platform 202 when the target assembly 204 (FIG. 2) is mated to the mounting platform 202. During the mounting operation, the target assembly 204 is positioned relative to the receiving stage 210 such that the target neck 254 may be inserted into a beam passage 460. The target assembly 204 is moved in a mounting direction 468 along the mating axis 291 (or the axis 295) toward the mounting platform 202 or, more specifically, the stage adapter 209. In an exemplary embodiment, the mounting operation includes only a single movement of the target assembly 204 toward the mounting platform 202.

In the illustrated embodiment, the beam passage 460 is formed when the stage thru-hole 344 and the base thru-hole 410 are combined. The beam passage 460 opens to the receiving stage 210 and is configured to align with the beam cavity 216 (FIG. 2) as the target assembly 204 is mounted to the receiving stage 210. As the target neck 254 is inserted into the beam passage 460, the distal end portion 452 may engage the sealing member 456 and compress the sealing member 456 between the neck surface 450 and the platform base 207. Accordingly, a vacuum-sealed path for the particle beam may be established that includes the beam passage 460 and the beam cavity 216. During operation of the isotope production system, the particle beam projects through the beam passage 460 and through the receiving stage 210 and into the beam cavity 216 where the particle beam is incident upon the target material.

The neck surface 450 also defines a neck recess 458. In an exemplary embodiment, the neck recess 458 extends circumferentially around the designated axis 295. In other embodiments, however, the neck recess 458 may extend only partially around the designated axis 295. The neck recess 458 is configured to receive the locking ring 382. As the target assembly 204 is mounted to the receiving stage 410, the target assembly 204 engages the movable actuator 348 (FIG. 5) causing the locking post 384 to engage and move the locking ring 382 into the neck recess 458. When the movable actuator 348 is moved by the target assembly 204, the movable actuator 348 engages the locking post 384 and drives the locking post 384 radially away from or, alternatively, toward the designated axis 295, thereby causing a lateral force 461 that moves the locking ring 382 into the neck recess 458. The lateral force 461 may be parallel to a length of the locking post 384. In the illustrated embodiment, the locking post 384 is moved away from the target neck 254. In other embodiments, the locking post 384 may be moved toward the target neck 254. When the locking ring 382 is disposed within the neck recess 458, the locking ring 382 prevents the target neck 254 and, consequently, the target assembly 204 from being inadvertently withdrawn. In such a configuration, the locking device 350 (FIG. 6) holds the target assembly 204 in a locked position with respect to the mounting platform 202. When the target assembly 204 is secured to the receiving stage 210 in the locked position, the locking ring 382 is at least partially disposed within the neck recess 458 such that the target assembly 204 may not be withdrawn or demounted from the receiving stage 210.

To remove the target assembly 204, a user may press the locking post 348 radially inward toward the designated axis 295 thereby moving the locking ring 382 from the neck recess 458. As such, the target assembly 204 may be freely demounted with respect to the mounting platform 202. The actuator spring 380 may move the movable actuator 348 away from the stage surface 338. In some embodiments, the biasing members 366 and the actuator spring 380 may provide a demounting force 462 against the target assembly 204 to facilitate demounting the target assembly 204 with respect to the mounting platform 202.

Accordingly, a single movement of the target assembly 204 toward the mounting platform 202 may fluidically, electrically, and mechanically couple the target assembly 204 and the mounting platform 202. The fluidic connections may include connections for providing cooling fluid (e.g., liquid or gas), the target material (e.g., liquid or gas), and a vacuum seal engagement such that a vacuum may be maintained within the beam passage 460 throughout generation of the particle beam. In some embodiments, the fluidic connections for the target material occur before or after the mounting operation. For example, the nozzles 312, 314 (FIG. 3) and respective tubes (not shown) may be fluidically connected to the target body 212 (FIG. 2) before or after the mounting operation.

In alternative embodiments, the mounting operation may include multiple steps. For example, a single movement similar to the mounting operation described above may cause the fluidic and electrical connections. Subsequently, an additional action by the user may secure the target assembly 204 to the mounting platform 202. For example, the user may pull a lever attached to the mounting platform 202 or the target assembly 204 that activates a latching mechanism that secures the mounting platform 202 and the target assembly 204 to each other.

Figure 12:
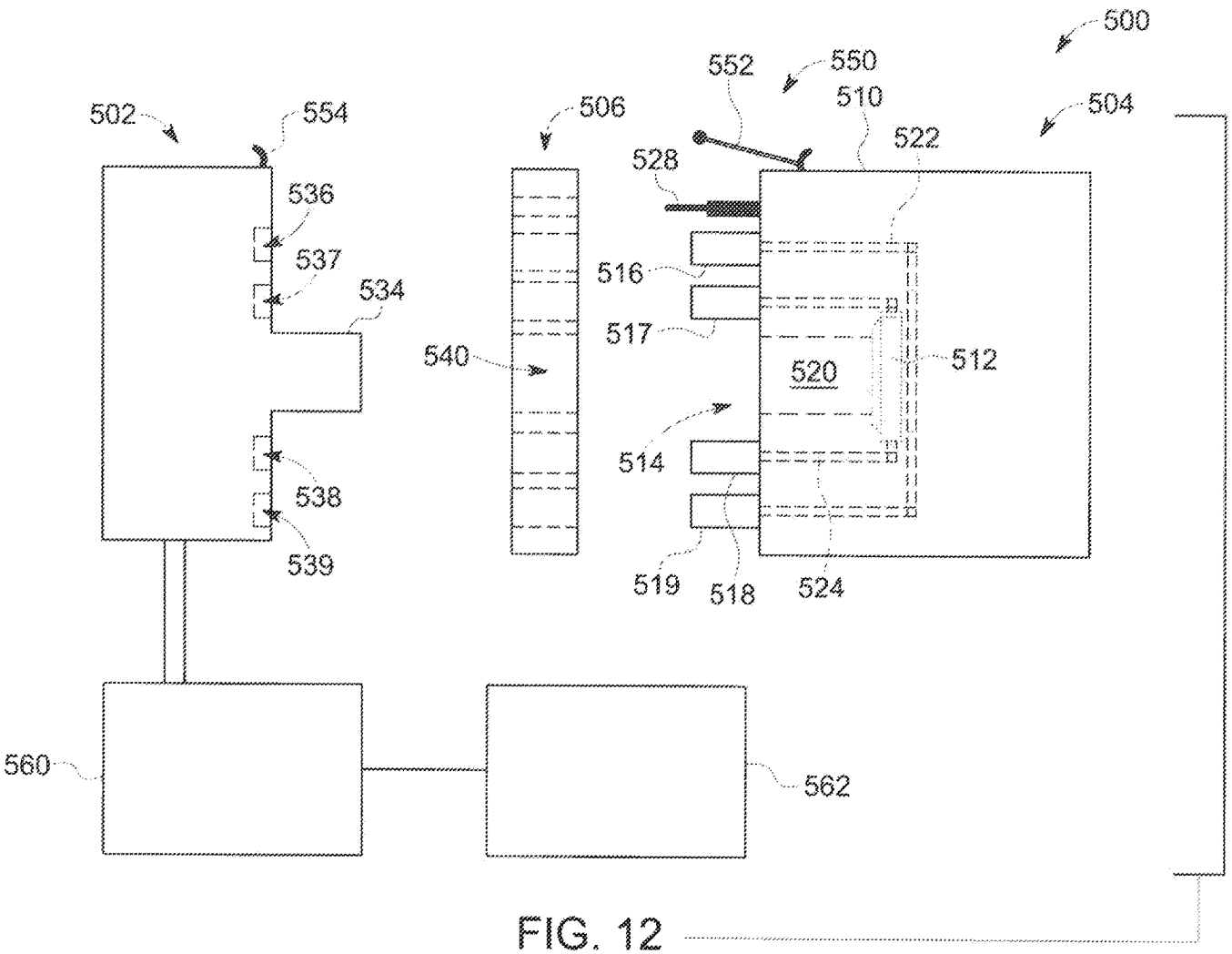
FIG. 12 is a schematic diagram of a production assembly formed in accordance with an embodiment.

FIG. 12 illustrates a production assembly 500 formed in accordance with one embodiment that may be used with an isotope production system. The production assembly 500 may have similar or identical components as the production assembly 200 (FIG. 2). For example, the production assembly 500 includes a platform base 502, a target assembly 504, and a stage adapter 506. The stage adapter 506 is configured to be disposed between the platform base 502 and the target assembly 504 and operably interconnect the platform base 502 and the target assembly 504. The stage adapter 506 may also electrically isolate the platform base 502 and the target assembly 504. In the illustrated embodiment, the stage adapter 506 is secured to the target assembly 504 prior to being secured to the platform base 502. As such, the stage adapter 506 may be characterized as being part of the target assembly 504. In other embodiments, however, the stage adapter 506 may be secured to the platform base 502 prior to being coupled to the target assembly 504.

As shown, the target assembly 504 includes a target body 510 that defines a production chamber 512. The production chamber 512 is configured to hold a target material for isotope production. The target assembly 504 includes a mating side 514 that is configured to removably engage the stage adapter 506. The mating side 514 includes target ports 516-519 (e.g., nozzles) and a beam cavity 520 that is aligned with the production chamber 512. The target port 516, 519 are in flow communication with a body channel 522 that extends through the target assembly 504. The target ports 517, 518 are in flow communication with a body channel 524 that extends through the target assembly 504. In the illustrated embodiment, the body channel 522 is a cooling channel that is configured to remove thermal energy from the production chamber 512, and the body channel 524 is a material channel that is in flow communication with the production chamber 512 and is configured to direct a target material toward and away from the production chamber 512. The target assembly 504 also includes an electrical contact 528, which may be similar or identical to the pogo-style pin 352 (FIG. 6). When the stage adapter 506 is coupled to the mating side 514, the electrical contact 528 and the target ports 516-519 may extend through and clear the stage adapter 506. In some embodiments, a locking device (not shown) may be used to secure the stage adapter 506 to the target assembly 504.

The mounting platform 502 includes a beam passage 530 and stage ports 536-539 that are separate from the beam passage 530. A particle beam is configured to project through the beam passage 530. The stage ports 536-539 are configured to fluidically couple to the stage ports 516-519, respectively. To assemble the production assembly 500, the stage adapter 506 may be secured to the mating side 514 of the target assembly 504. This coupled structure may then be secured to the platform base 502 during a mounting operation. More specifically, a target neck 534 of the platform base 502 may be inserted through a thru-hole 540 of the stage adapter 506 and into the beam cavity 520. The target neck 534 may engage a sealing member (not shown) disposed within the beam cavity 520 to form a vacuum seal between the target assembly 504 and the platform base 502.

The production assembly 500 may also include a locking device 550. For example, the locking device 550 includes a latch 552 that is coupled to the target assembly 504. In some embodiments, after the stage adapter 506 and the target assembly 504 are mounted to the platform base 502, the latch 552 may be activated by the user to engage a hook 554 that is secured to the platform base 502. In other embodiments, the latch 552 may be secured to the stage adapter 506. Yet in alternative embodiments, the latch 552 may be secured to the platform base 502 and the hook 554 may be secured to the stage adapter 506 or the target assembly 504. Yet in other embodiments, the locking device 550 may be similar to the locking device 350.

As demonstrated by the production assemblies 200 and 500, many of the components may be coupled to any of the platform base, the stage adapter, or the target assembly. For example, the target neck may be coupled to the target assembly or the platform base. It is also contemplated that the stage adapter may include a target neck. Moreover, either of the platform base or the target assembly may have an electrical contact that projects away from the respective component.

In the illustrated embodiment, the platform base 502 is configured to engage a single target assembly 504. In other embodiments, the platform base 502 may be configured to engage multiple target assemblies 504, such as the mounting platform 202 (FIG. 2). In other embodiments, the locking devices described herein may include fewer or more structural components. For example, the locking devices may include fewer or more linkages (e.g., links or springs) that operably couple to each other to block the target neck from moving out of the beam passage. In other embodiments, the locking devices may directly couple the adapter body (or the platform base) to the target assembly. More specifically, instead of engaging the target neck, the locking device may engage the target body. If the target assembly includes the locking device, the locking device may engage the adapter body and/or the platform base.

Also shown, the platform base 502 is in flow communication with a fluid-control system 560 of the isotope production system (not shown). The fluid-control system 560 may include one or more pumps, valves, and storage containers. The fluid-control system 560 is configured to control the flow of fluid (e.g., liquid or gas) through the production assembly 500. For example, the fluid-control system 560 may provide a cooling liquid to the platform base 502 and the target assembly 504 and a target material to the target assembly 504. Also shown, the isotope production system may include a control system 562. The control system 562 may control or monitor operation of the isotope production system. For example, the control system 562 may control operation of the fluid-control system 560 and/or monitor the target assembly 504. The fluidic-control system 560 and the control system 562 may be similar to corresponding systems described in U.S. Patent Application Publication No. 2011/0255646 and in U.S. patent application Ser. Nos. 12/492,200; 12/435,903; 12/435,949; 12/435,931; 14/575,993; 14/575,914; 14/575,958; 14/575,885; and Ser. No. 14/755,007, each of which is incorporated herein by reference in its entirety.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand alone programs, may be incorporated as subroutines in an operating system, may be functions in an installed software package, or the like. The various embodiments are not limited to the arrangements and instrumentality shown in the drawings.

What is claimed is:

1. A production assembly for an isotope production system, the production assembly comprising:

a mounting platform including a receiving stage that faces an exterior of the mounting platform, the mounting platform including a beam passage that opens to the receiving stage and a stage port that is positioned along the receiving stage and separate from the beam passage, wherein a particle beam is configured to project through the beam passage and through the receiving stage during operation of the isotope production system, and wherein the stage port is configured to provide or receive a fluid through the receiving stage during operation of the isotope production system; and a target assembly having a production chamber configured to hold a target material for isotope production, the target assembly including a mating side that is configured to removably engage the receiving stage during a mounting operation, the mating side including a target port and a beam cavity that is aligned with the production chamber, the target port being in flow communication with a body channel that extends through the target assembly, wherein the target port fluidically couples to the stage port and the beam passage aligns with the beam cavity as the target assembly is mounted to the receiving stage.

2. The production assembly of claim 1, wherein the mounting platform includes a platform base and a stage adapter that is secured to the platform base and includes the receiving stage, the stage adapter including an insulative adapter body that is positioned between the platform base and the target assembly and electrically separates the platform base and the target assembly during operation, the stage adapter including the stage port and a portion of the beam passage.

3. The production assembly of claim 2, wherein the mounting platform includes a sealing member positioned within the beam passage and the target assembly includes a target neck that is configured to project into the beam passage when the target assembly is mounted to the mounting platform, the sealing member surrounding the target neck within the beam passage.

4. The production assembly of claim 1, further comprising a locking device having a movable actuator that is coupled to one of the mounting platform or the target assembly, the movable actuator configured to be engaged by the other of the mounting platform or the target assembly during the mounting operation thereby causing the movable actuator to move to a locked position, the locking device holding the target assembly against the mounting platform when the movable actuator is in the locked position.

5. The production assembly of claim 1, wherein the mounting platform includes an electrical contact positioned along the receiving stage and the target assembly includes an electrical contact positioned along the mating side, the electrical contact of the target assembly being electrically coupled to a surface that defines the production chamber, the electrical contacts of the mounting platform and the target assembly engaging each other during the mounting operation.

6. The production assembly of claim 1, wherein the stage port is an outlet stage port and the mounting platform further comprises an inlet stage port, and wherein the target port is an inlet target port and the target assembly further comprises an outlet target port, the outlet stage port and the inlet target port configured to be fluidically coupled to each other when the target assembly is mounted to the receiving stage and the inlet stage port and the outlet target port configured to be fluidically coupled to each other when the target assembly is mounted to the receiving stage, wherein the outlet stage port is configured to be in flow communication with the inlet stage port through the target assembly when the target assembly is mounted to the receiving stage.

7. The production assembly of claim 6, wherein the target assembly includes a cooling channel that flows proximate to the production chamber to absorb thermal energy therefrom, the outlet stage port being in flow communication with the inlet stage port through the cooling channel.

8. The production assembly of claim 6, wherein the outlet stage port is in flow communication with the inlet stage port through the production chamber.

9. The production assembly of claim 1, wherein the mounting platform includes a plurality of the receiving stages, each of the receiving stages capable of removably engaging, at separate times, the target assembly.

* * * * *